US007922569B2

(12) United States Patent
Li

(10) Patent No.: US 7,922,569 B2
(45) Date of Patent: Apr. 12, 2011

(54) COIN COUNTER HAVING A DISTANCE ADJUSTMENT FUNCTION

(76) Inventor: Chiu-Fang Li, Tainan (TW)

( * ) Notice: Subject to any disclaimer, the term of this patent is extended or adjusted under 35 U.S.C. 154(b) by 0 days.

(21) Appl. No.: 12/577,919

(22) Filed: Oct. 13, 2009

(65) Prior Publication Data

US 2010/0263985 A1 Oct. 21, 2010

(30) Foreign Application Priority Data

Apr. 15, 2009 (TW) ..... 98112565 A

(51) Int. Cl.
*G07D 3/00* (2006.01)

(52) U.S. Cl. ..... 453/12; 453/13; 453/33; 453/49; 453/57

(58) Field of Classification Search ..... 453/6, 10, 453/12, 13, 33–35, 49, 57
See application file for complete search history.

(56) References Cited

U.S. PATENT DOCUMENTS 7,244,176 B2 * 7/2007 Chang ..... 453/18
2007/0066202 A1 * 3/2007 Hu et al. ..... 453/18

* cited by examiner

*Primary Examiner* — Jeffrey A Shapiro
(74) *Attorney, Agent, or Firm* — Alan Kamrath; Kamrath & Associates PA

(57) ABSTRACT

A coin counter includes a base unit, an adjusting plate adjustably mounted on the base unit, and a coin outlet port mounted on the base unit. The adjusting plate has a first end provided with an adjusting slot and a second end provided with a micro-adjusting slot. The adjusting plate has a mediate portion provided with a guide slot located between the adjusting slot and the micro-adjusting slot. Thus, by provision of the micro-adjusting slot of the adjusting plate, the pitch angle of the adjusting plate can be slightly adjusted to slightly adjust and control the projecting distance of each of the coins so that each of the coins can be projected onto the coin outlet port exactly to facilitate collection of the coins.

14 Claims, 7 Drawing Sheets

COIN COUNTER HAVING A DISTANCE ADJUSTMENT FUNCTION

BACKGROUND OF THE INVENTION

1. Field of the Invention

The present invention relates to a coin counter and, more particularly, to a coin counter for counting coins in a bank or an amusement ground.

2. Description of the Related Art

A conventional coin counter comprises a support frame, a rotation disk rotatably mounted on the support frame, a stop plate mounted on the support frame, a spring-biased limit rod slidably mounted on the support frame and spaced from the stop plate, and a coin outlet port mounted on the support frame and located between the stop plate and the limit rod. The rotation disk has a peripheral wall provided with a plurality of passages to allow passage of a plurality of coins. Thus, each of the coins is carried by rotation of the rotation disk and can be inserted between the stop plate and the limit rod toward the coin outlet port. In operation, when the rotation disk is rotated, each of the coins is carried by rotation of the rotation disk and can be inserted between the stop plate and the limit rod toward the coin outlet port. At this time, a microswitch mounted on the limit rod is used to count the number of the coins. Then, each of the coins is carried and guided outwardly by the coin outlet port and is dropped onto and received in a container. In adjustment, the distance between the stop plate and the limit rod can be adjusted so as to allow passage of the coins of different sizes. However, the pitch angle of the stop plate cannot be adjusted so that the projecting distance of each of the coins cannot be changed and controlled. Thus, the coins cannot be projected onto the container exactly, thereby causing inconvenience in collection of the coins.

BRIEF SUMMARY OF THE INVENTION

In accordance with the present invention, there is provided a coin counter, comprising a base unit and an adjusting plate adjustably mounted on the base unit. The adjusting plate has a first end provided with an adjusting slot and a second end provided with a micro-adjusting slot. The adjusting plate has a mediate portion provided with a guide slot located between the adjusting slot and the micro-adjusting slot.

The primary objective of the present invention is to provide a coin counter having a distance adjustment function.

According to the primary objective of the present invention, by provision of the micro-adjusting slot of the adjusting plate, the pitch angle of the adjusting plate can be slightly adjusted to slightly adjust and control the projecting distance of each of the coins so that each of the coins can be projected onto the coin outlet port exactly to facilitate collection of the coins.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
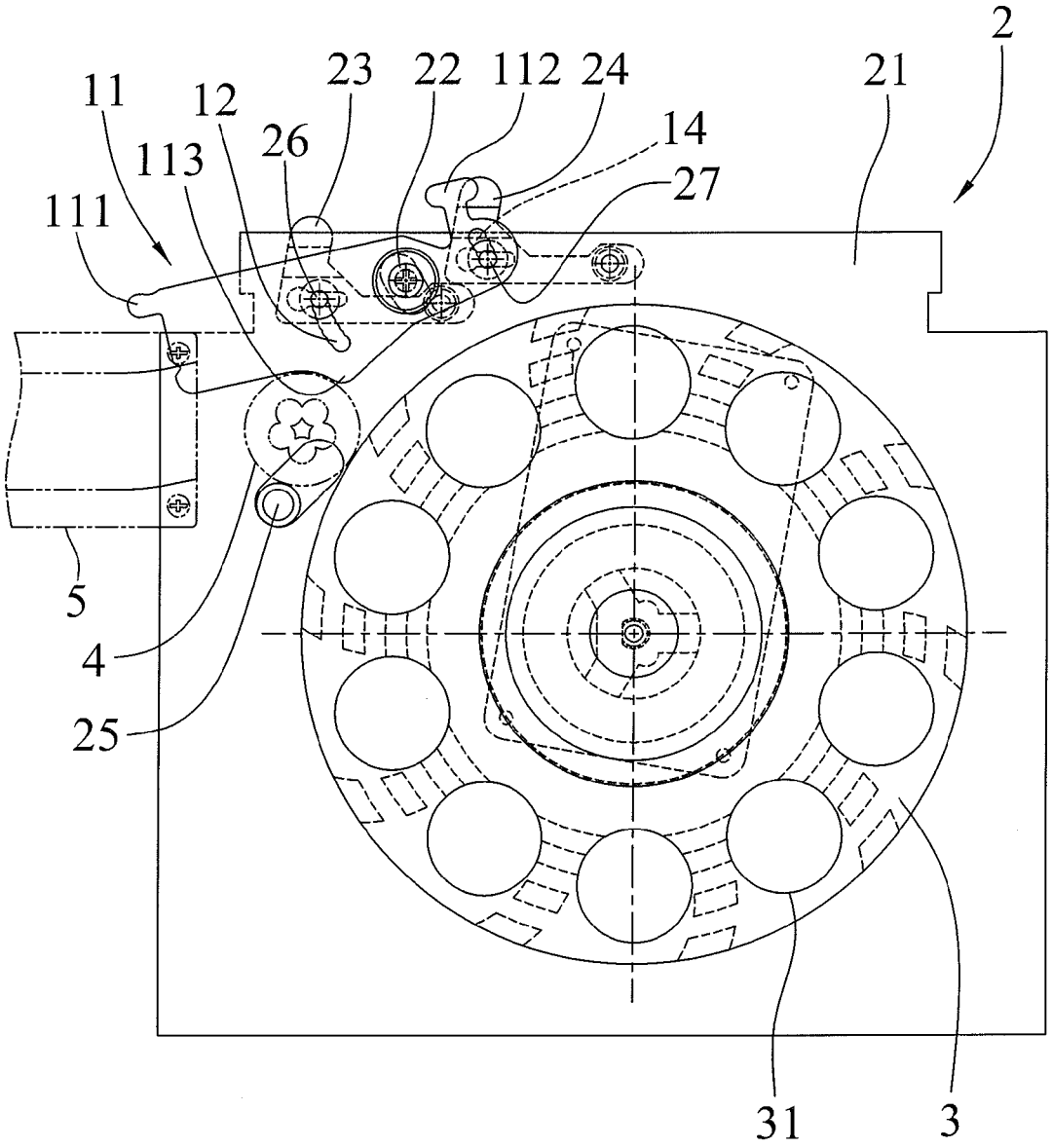
FIG. 1 is a front view of a coin counter in accordance with the preferred embodiment of the present invention.
Figure 2:
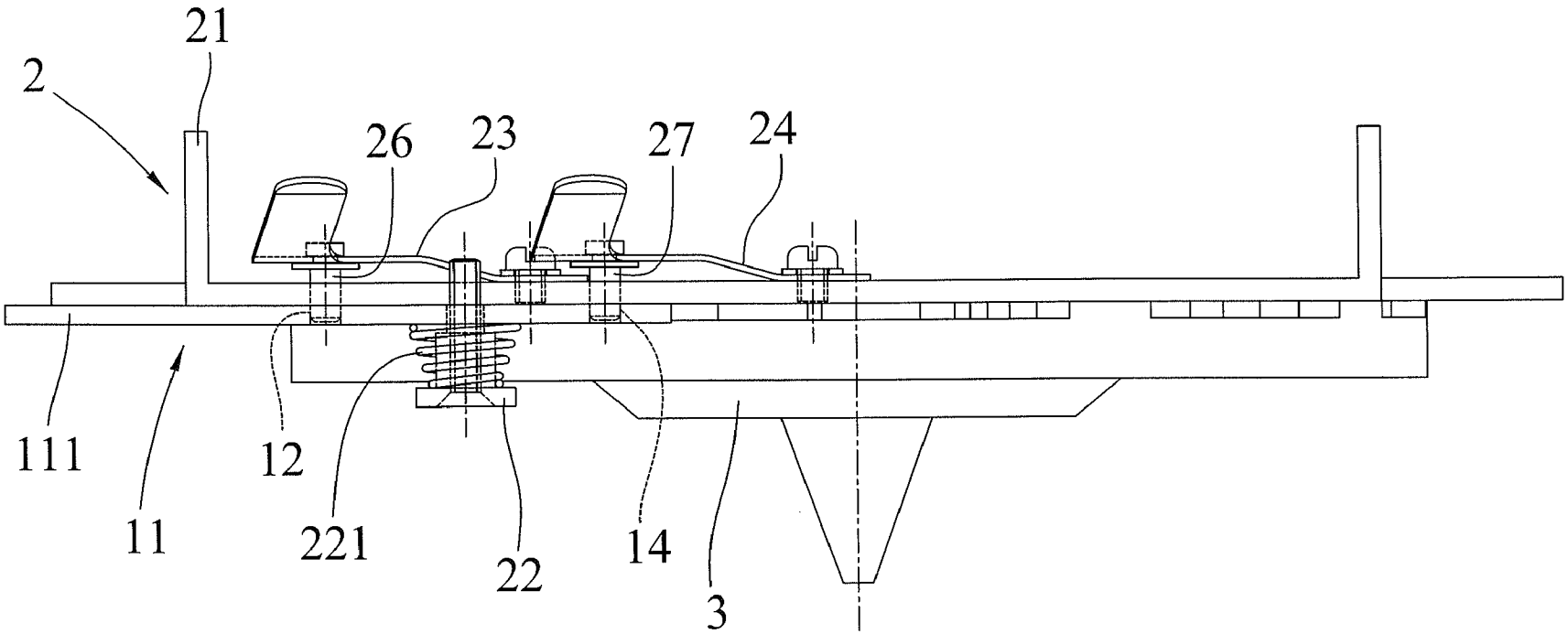
FIG. 2 is a top view of the coin counter as shown in FIG. 1.
Figure 3:
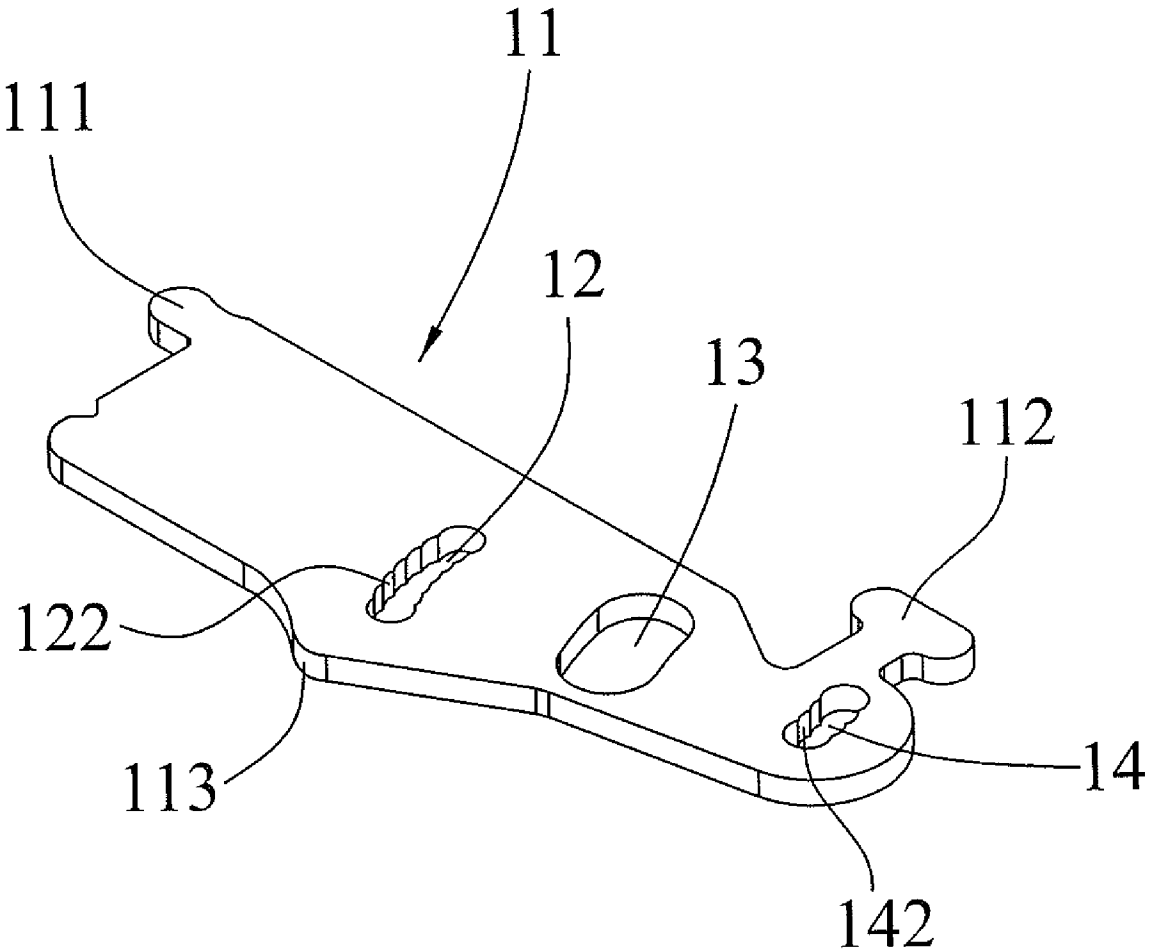
FIG. 3 is a perspective view of an adjusting plate of the coin counter as shown in FIG. 1.

Referring to the drawings and initially to FIGS. 1-3, a coin counter in accordance with the preferred embodiment of the present invention comprises a base unit 2, an adjusting plate 11 adjustably mounted on the base unit 2, and a rotation disk 3 rotatably mounted on the base unit 2.

The adjusting plate 11 has a first end provided with an adjusting slot 12 and a second end provided with a micro-adjusting slot 14. The adjusting plate 11 has a mediate portion provided with a guide slot 13 located between the adjusting slot 12 and the micro-adjusting slot 14. The adjusting slot 12 of the adjusting plate 11 has a length greater than that of the micro-adjusting slot 14. The adjusting slot 12 of the adjusting plate 11 has a substantially arc-shaped profile and has two opposite sides each provided with a plurality of corrugated positioning recesses 122. The micro-adjusting slot 14 of the adjusting plate 11 has a substantially arc-shaped profile and has two opposite sides each provided with a plurality of corrugated positioning depressions 142.

The first end of the adjusting plate 11 has a side provided with an adjusting knob 111, and the second end of the adjusting plate 11 has a side provided with a micro-adjusting knob 112. The adjusting slot 12 of the adjusting plate 11 is located between the adjusting knob 111 and the guide slot 13, and the micro-adjusting knob 112 is located between the micro-adjusting slot 14 and the guide slot 13. The adjusting knob 111 of the adjusting plate 11 protrudes outwardly from the base unit 2, and the micro-adjusting knob 112 of the adjusting plate 11 protrudes outwardly from the base unit 2.

The adjusting plate 11 has a side provided with a protruding press portion 113. The press portion 113 of the adjusting plate 11 is located beside the adjusting slot 12 and is located between the micro-adjusting slot 14 and the adjusting knob 111.

The base unit 2 includes a support frame 21 to support the adjusting plate 11, a spring-biased limit rod 25 slidably mounted on the support frame 21 and spaced from the adjusting plate 11, a locking rod 26 extending through the support frame 21 and detachably locked in the adjusting slot 12 of the adjusting plate 11, an elastic plate 23 having a first end mounted on the support frame 21 and a second end connected with the locking rod 26 to drive the locking rod 26 to move relative to the support frame 21 and the adjusting plate 11, a locking shaft 27 extending through the support frame 21 and detachably locked in the micro-adjusting slot 14 of the adjusting plate 11, an elastic piece 24 having a first end mounted on the support frame 21 and a second end connected with the locking shaft 27 to drive the locking shaft 27 to move relative to the support frame 21 and the adjusting plate 11, a guide member 22 mounted on the support frame 21 and extending through the guide slot 13 of the adjusting plate 11, and a biasing member 221 mounted on the guide member 22 and biased between the guide member 22 and the adjusting plate 11 to press the adjusting plate 11 toward the support frame 21.

The locking rod 26 of the base unit 2 is movable relative to the support frame 21 and the adjusting plate 11 and has a first end detachably positioned in one of the positioning recesses 122 of the adjusting slot 12 of the adjusting plate 11 and a second end attached to the second end of the elastic plate 23. The locking shaft 27 of the base unit 2 is movable relative to the support frame 21 and the adjusting plate 11 and has a first end detachably positioned in one of the positioning depressions 142 of the micro-adjusting slot 14 of the adjusting plate 11 and a second end attached to the second end of the elastic piece 24.

Thus, the micro-adjusting slot 14 of the adjusting plate 11 is pivotable about the locking shaft 27 of the base unit 2 when the locking rod 26 of the base unit 2 is detached from the adjusting slot 12 of the adjusting plate 11, the adjusting slot 12 of the adjusting plate 11 is pivotable about the locking rod 26 of the base unit 2 when the locking shaft 27 of the base unit 2 is detached from the micro-adjusting slot 14 of the adjusting plate 11, and the guide slot 13 of the adjusting plate 11 is movable on the guide member 22 when the adjusting plate 11 is pivoted about the locking shaft 27 or the locking rod 26 of the base unit 2.

The coin counter further comprises a coin outlet port 5 mounted on the support frame 21 of the base unit 2 and located between the adjusting plate 11 and the limit rod 25 of the base unit 2. The rotation disk 3 is rotatably mounted on the support frame 21 of the base unit 2 and has a peripheral wall provided with a plurality of passages 31 to allow passage of a plurality of coins 4. Thus, each of the coins 4 is carried by rotation of the rotation disk 3 and can be inserted between the adjusting plate 11 and the limit rod 25 of the base unit 2 toward the coin outlet port 5.

In operation, when the rotation disk 3 is rotated, each of the coins 4 is carried by rotation of the rotation disk 3 and can be inserted between the press portion 113 of the adjusting plate 11 and the limit rod 25 of the base unit 2 toward the coin outlet port 5. At this time, a microswitch (not shown) mounted on the limit rod 25 of the base unit 2 is used to count the number of the coins 4. Then, each of the coins 4 is carried and guided outwardly by the coin outlet port 5 and is dropped onto and received in a container (not shown).

Figure 4:
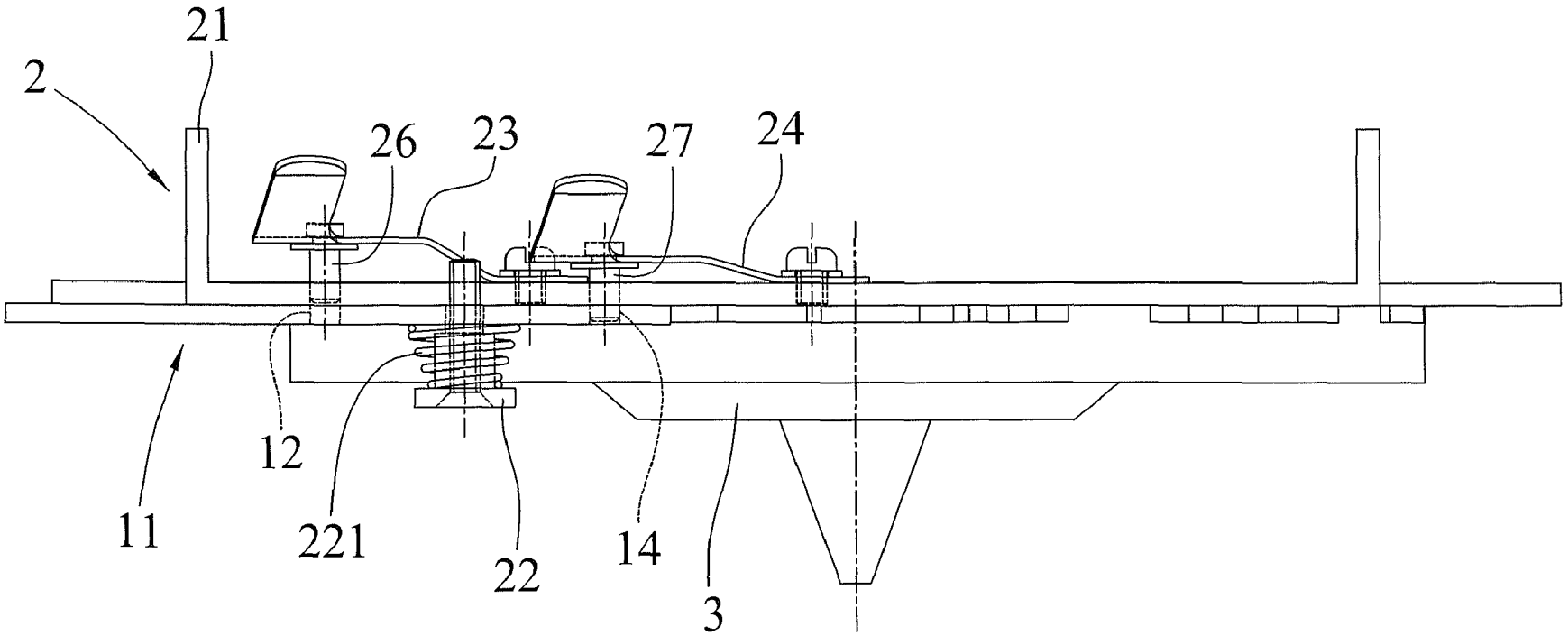
FIG. 4 is a schematic operational view of the coin counter as shown in FIG. 2.
Figure 5:
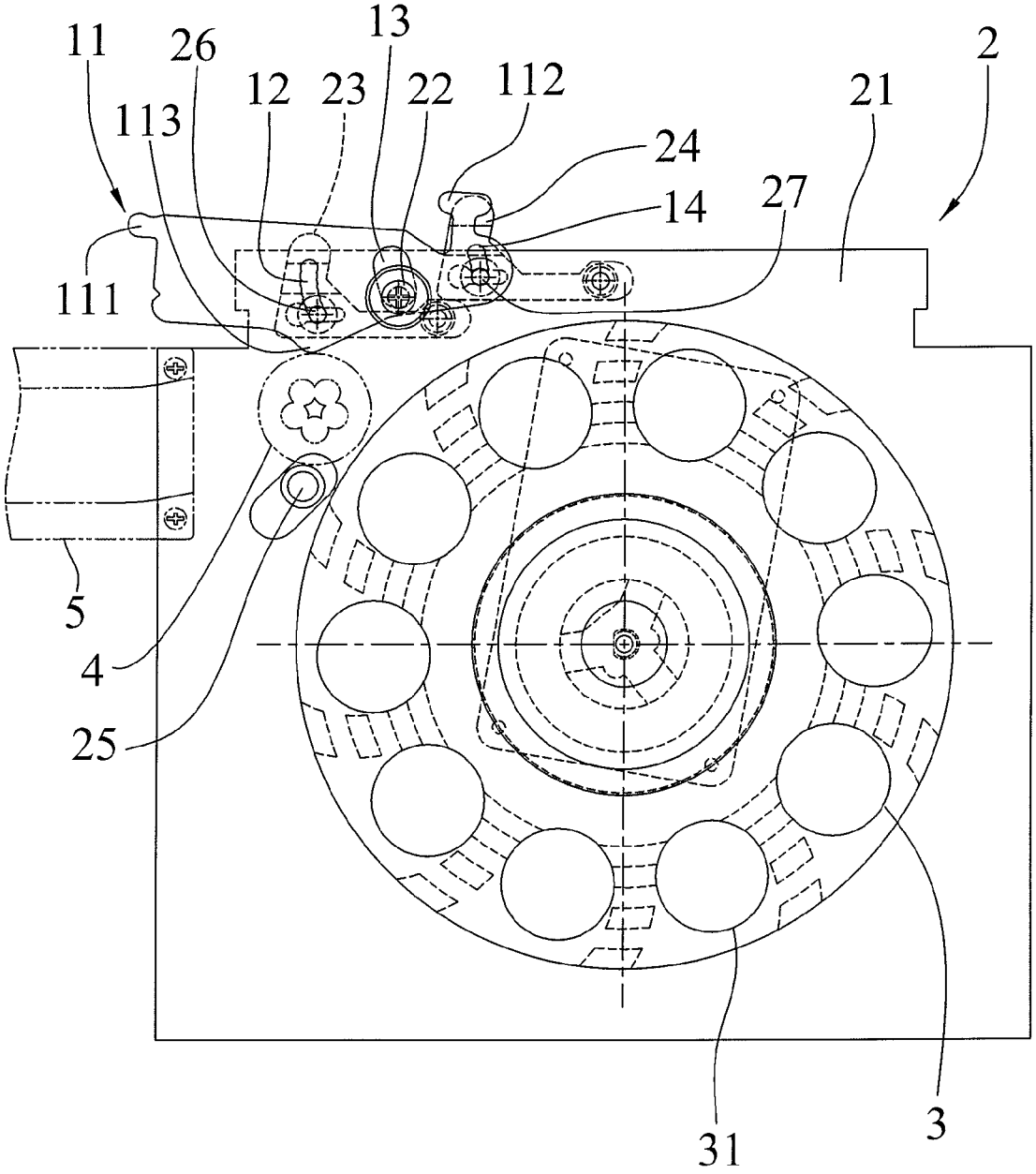
FIG. 5 is a schematic operational view of the coin counter as shown in FIG. 1.

In adjustment, referring to FIGS. 4 and 5 with reference to FIGS. 1-3, when the elastic plate 23 of the base unit 2 is moved outwardly relative to the support frame 21 of the base unit 2, the locking rod 26 of the base unit 2 is moved to detach from the adjusting slot 12 of the adjusting plate 11 as shown in FIG. 4 so as to unlock the adjusting plate 11 from the locking rod 26 of the base unit 2, so that the adjusting plate 11 is pivotable on the support frame 21 of the base unit 2. Thus, a user can hold the adjusting knob 111 of the adjusting plate 11 to drive the micro-adjusting slot 14 of the adjusting plate 11 to pivot about the locking shaft 27 of the base unit 2 so that the adjusting plate 11 is moved from the position as shown in FIG. 1 to the position as shown in FIG. 5 to change and adjust the distance between the press portion 113 of the adjusting plate 11 and the limit rod 25 of the base unit 2 so as to allow passage of the coins 4 of different sizes. After the force applied on the elastic plate 23 of the base unit 2 is removed, the elastic plate 23 is moved toward the support frame 21 of the base unit 2 by its restoring force, so that the locking rod 26 of the base unit 2 is inserted into and locked in the adjusting slot 12 of the adjusting plate 11 as shown in FIG. 2 so as to lock the adjusting plate 11 onto the locking rod 26 of the base unit 2 again.

Figure 6:
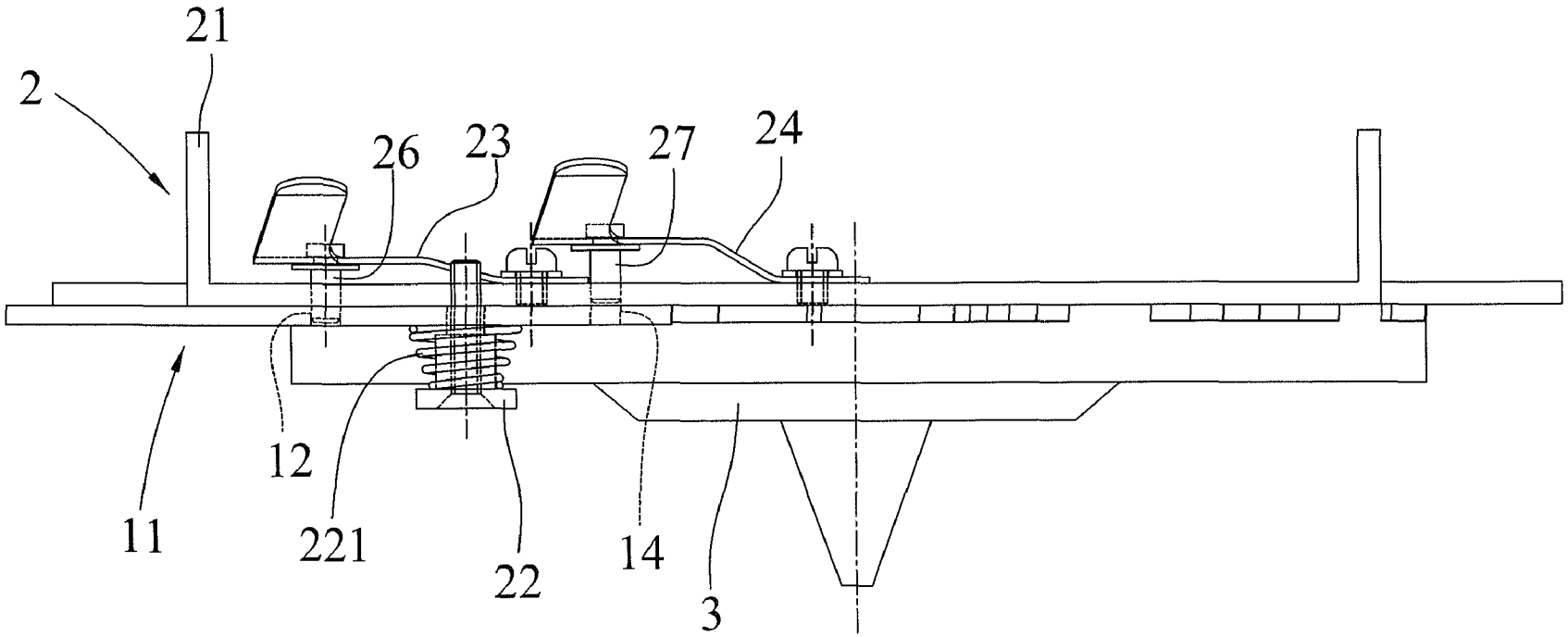
FIG. 6 is a schematic operational view of the coin counter as shown in FIG. 2.
Figure 7:
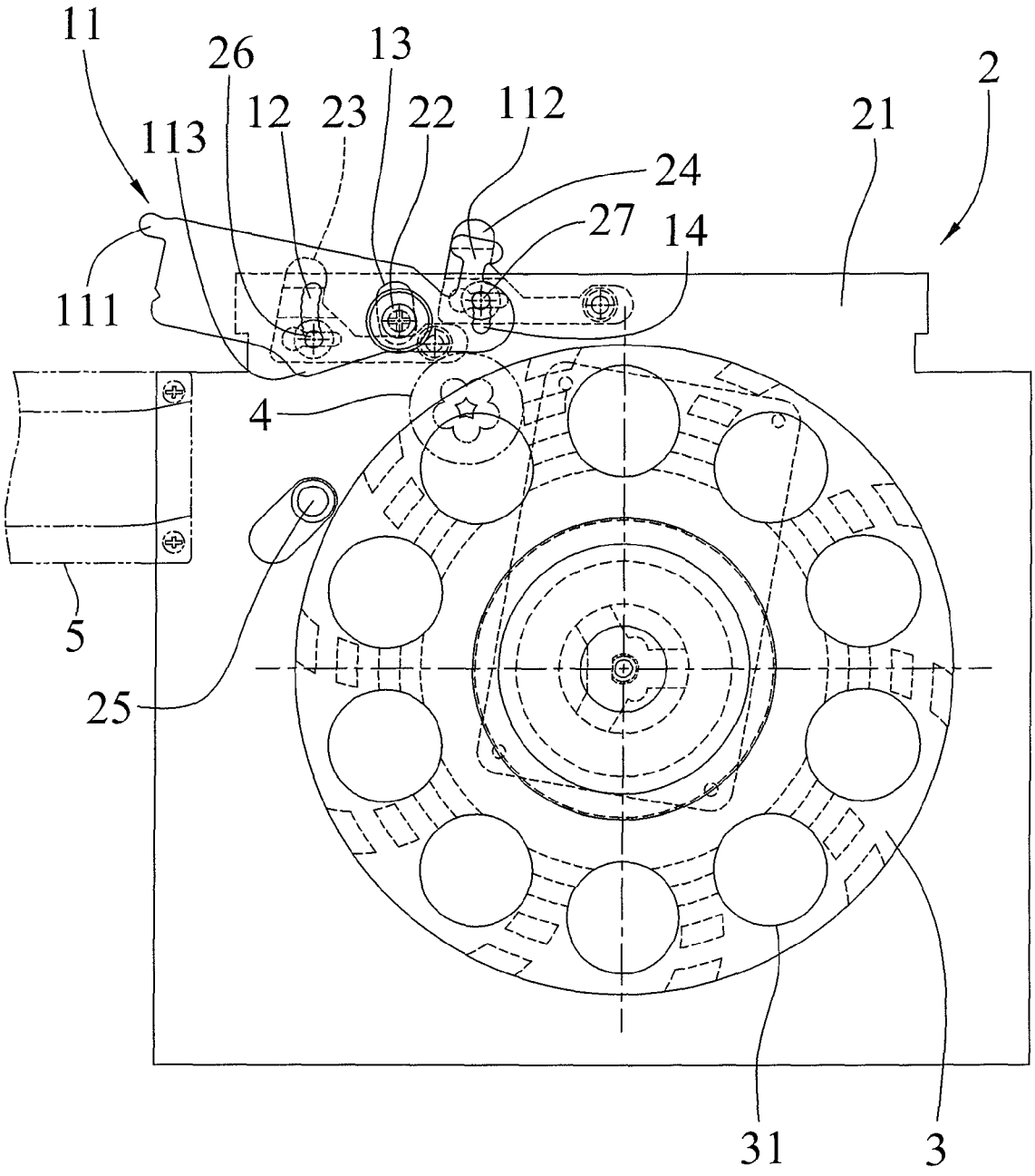
FIG. 7 is a schematic operational view of the coin counter as shown in FIG. 5.

On the other hand, referring to FIGS. 6 and 7 with reference to FIGS. 1-5, when the elastic piece 24 of the base unit 2 is moved outwardly relative to the support frame 21 of the base unit 2, the locking shaft 27 of the base unit 2 is moved to detach from the micro-adjusting slot 14 of the adjusting plate 11 as shown in FIG. 6 so as to unlock the adjusting plate 11 from the locking shaft 27 of the base unit 2, so that the adjusting plate 11 is pivotable on the support frame 21 of the base unit 2. Thus, the user can hold the micro-adjusting knob 112 of the adjusting plate 11 to drive the adjusting slot 12 of the adjusting plate 11 to pivot about the locking rod 26 of the base unit 2 so that the adjusting plate 11 is moved from the position as shown in FIG. 5 to the position as shown in FIG. 7 to change and adjust the pitch angle of the press portion 113 of the adjusting plate 11 and to slightly adjust the projecting distance of each of the coins 4. After the force applied on the elastic piece 24 of the base unit 2 is removed, the elastic piece 24 is moved toward the support frame 21 of the base unit 2 by its restoring force, so that the locking shaft 27 of the base unit 2 is inserted into and locked in the micro-adjusting slot 14 of the adjusting plate 11 as shown in FIG. 2 so as to lock the adjusting plate 11 onto the locking shaft 27 of the base unit 2 again.

Accordingly, by provision of the micro-adjusting slot 14 of the adjusting plate 11, the pitch angle of the adjusting plate 11 can be slightly adjusted to slightly adjust and control the projecting distance of each of the coins 4 so that each of the coins 4 can be projected onto the coin outlet port 5 and the container exactly to facilitate collection of the coins 4.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A coin counter for counting coins, comprising:
a base unit;
a rotation disk rotatably mounted on the base unit;
an adjusting plate adjustably mounted on the base unit for adjusting its pitch angle and therefore a projecting distance of each of the coins through a coin outlet port;
a biased limit rod slidably mounted on the base unit and spaced from the adjusting plate;
wherein the coin outlet port is mounted on the base unit and located between the adjusting plate and the limit rod;
wherein the adjusting plate has a first end provided with an adjusting slot and a second end provided with a micro-adjusting slot;
the adjusting plate has a mediate portion provided with a guide slot located between the adjusting slot and the micro-adjusting slot;
the base unit includes:
a support frame to support the adjusting plate;
a locking rod extending through the support frame and detachably locked in the adjusting slot of the adjusting plate;
a locking shaft extending through the support frame and detachably locked in the micro-adjusting, slot of the adjusting plate;
a guide member mounted on the support frame and extending through the guide slot of the adjusting plate;
the base unit further includes:
a biasing member mounted on the guide member and biased between the guide member and the adjusting plate to press the adjusting plate toward the support frame.

2. The coin counter of claim 1, wherein the adjusting slot of the adjusting plate has a substantially arc-shaped profile.

3. A coin counter for counting coins, comprising:
a base unit;
a rotation disk rotatably mounted on the base unit;

an adjusting plate adjustably mounted on the base unit for adjusting its pitch angle and therefore a projecting distance of each of the coins through a coin outlet port;

a biased limit rod slidably mounted on the base unit and spaced from the adjusting plate:

wherein coin outlet port is mounted on the base unit and located between the adjusting plate and the limit rod;

wherein the adjusting plate has a first end provided with an adjusting slot and a second end provided with a micro-adjusting slot;

the adjusting plate has a mediate portion provided with a guide slot located between the adjusting slot and the micro-adjusting slot;

the base unit includes:

a support frame to support the adjusting plate;

a locking rod extending through the support frame and detachably locked in the adjusting slot of the adjusting plate;

a locking shaft extending through the support frame and detachably locked in the micro-adjusting slot of the adjusting plate;

a guide member mounted on the support frame and extending through the guide slot of the adjusting plate;

the base unit further includes:

an elastic plate having a first end mounted on the support frame and a second end connected with the locking rod to drive the locking rod to move relative to the support frame and the adjusting plate;

the adjusting slot of the adjusting plate has two opposite sides each provided with a plurality of corrugated positioning recesses;

the locking rod of the base unit has a first end detachably positioned in one of the positioning recesses of the adjusting slot of the adjusting plate and a second end attached to the second end of the elastic plate.

4. The coin counter of claim 1, wherein the micro-adjusting slot of the adjusting plate has a substantially arc-shaped profile.

5. A coin counter for counting coins, comprising:

a base unit;

a rotation disk rotatably mounted on the base unit;

an adjusting plate adjustably mounted on the base unit for adjusting its pitch angle and therefore a projecting distance of each of the coins through a coin outlet port;

a biased limit rod slidably mounted on the base unit and spaced from the adjusting plate:

wherein the coin outlet port is mounted on the base unit and located between the adjusting plate and the limit rod;

wherein the adjusting plate has a first end provided with an adjusting slot and a second end provided with a micro-adjusting slot;

the adjusting plate has a mediate portion provided with a guide slot located between the adjusting slot and the micro-adjusting slot;

the base unit includes:

a support frame to support the adjusting plate;

a locking rod extending through the support frame and detachably locked in the adjusting slot of the adjusting plate;

a locking shaft extending through the support frame and detachably locked in the micro-adjusting slot of the adjusting plate;

a guide member mounted on the support frame and extending through the guide slot of the adjusting plate;

the base unit further includes:

an elastic piece having a first end mounted on the support frame and a second end connected with the locking shaft to drive the locking shaft to move relative to the support frame and the adjusting plate;

the micro-adjusting slot of the adjusting plate has two opposite sides each provided with a plurality of corrugated positioning depressions;

the locking shaft of the base unit has a first end detachably positioned in one of the positioning depressions of the micro-adjusting slot of the adjusting plate and a second end attached to the second end of the elastic piece.

6. The coin counter of claim 1, wherein the adjusting slot of the adjusting plate has a length greater than that of the micro-adjusting slot.

7. The coin counter of claim 1, wherein the first end of the adjusting plate has a side provided with an adjusting knob, the second end of the adjusting plate has a side provided with a micro-adjusting knob.

8. The coin counter of claim 7, wherein the adjusting slot of the adjusting plate is located between the adjusting knob and the guide slot;

the micro-adjusting knob is located between the micro-adjusting slot and the guide slot.

9. The coin counter of claim 7, wherein the adjusting knob of the adjusting plate protrudes outwardly from the base unit;

the micro-adjusting knob of the adjusting plate protrudes outwardly from the base unit.

10. The coin counter of claim 7, wherein the adjusting plate has a side provided with a protruding press portion;

the press portion of the adjusting plate is located beside the adjusting slot and is located between the micro-adjusting slot and the adjusting knob.

11. The coin counter of 1, wherein the locking rod of the base unit is movable relative to the support frame and the adjusting plate.

12. The coin counter of claim 1, wherein the locking shaft of the base unit is movable relative to the support frame and the adjusting plate.

13. The coin counter of claim 1, wherein the micro-adjusting slot of the adjusting plate is pivotable about the locking shaft of the base unit when the locking rod of the base unit is detached-from the adjusting slot of the adjusting plate;

the adjusting slot of the adjusting plate is pivotable about the locking rod of the base unit when the locking shaft of the base unit is detached from the micro-adjusting slot of the adjusting plate.

14. The coin counter of claim 13, wherein the guide slot of the adjusting plate is movable on the guide member when the adjusting plate is pivoted about the locking shaft or the locking rod of the base unit.

* * * * *